US006119498A

United States Patent [19]

Knudson

[11] Patent Number: 6,119,498

[45] Date of Patent: Sep. 19, 2000

[54] NODE ROLLER COMBINATION

[76] Inventor: Gary A. Knudson, 30401 Heavenly Ct., Evergreen, Colo. 80439

[21] Appl. No.: 09/322,783

[22] Filed: May 28, 1999

Related U.S. Application Data

[60] Provisional application No. 60/088,247, Jun. 5, 1998.

[51] Int. Cl.[7] ..... B21D 5/08

[52] U.S. Cl. ..... 72/177; 72/182

[58] Field of Search ..... 72/180, 177, 182, 72/176

[56] References Cited

U.S. PATENT DOCUMENTS

| | | | |
|---|---|---|---|
| 3,059,685 | 10/1962 | Behlen | 72/180 |
| 3,150,707 | 9/1964 | Howell | 72/177 |
| 3,165,815 | 1/1965 | Wogerbauer | 72/180 |
| 3,187,539 | 6/1965 | Shultz | 72/180 |
| 3,344,641 | 10/1967 | Pomory | 72/180 |

FOREIGN PATENT DOCUMENTS

| | | | |
|---|---|---|---|
| 629644 | 5/1936 | Germany | 72/182 |

*Primary Examiner*—Daniel C. Crane
*Attorney, Agent, or Firm*—Ancel W. Lewis, Jr.

[57] ABSTRACT

A node roller combination method and apparatus has a node roller and a backing roller between which sheet material is passed. The node roller has a series of ring shaped circumferential nodes at spaced intervals across the material. The nodes press the sheet material into the backing roller to form a series of small radius small angle bends between flat segments and repetitions of succeeding stages of node and backing rollers forming bends between previous bends that provide a curved shape that gives the appearance of a large radius bend without the tendency to spring back to an original shape.

22 Claims, 6 Drawing Sheets

NODE ROLLER COMBINATION

This application claims the benefit under 35 U.S.C. § 119(e) of the U.S. Provisional Patent Application Ser. No. 60/088,247 filed Jun. 5, 1998.

TECHNICAL FIELD

This invention relates to forming curves in sheet material and more particularly to a method and apparatus for roll forming curved shapes resembling large radius curves in a sheet material, particularly sheet metal, with a minimum return or spring back to the original shape.

BACKGROUND ART

The process of roll forming relatively small radius bends in most sheet metal materials (steel, aluminum, copper, zinc, etc.) is fairly simple. However, the process of roll forming relatively large radius bends is much more difficult. Sheet metal materials for which roll forming is carried out to form radius curves typically ranges from 0.01 inch to 0.10 inch in thickness.

Metallic or sheet metal materials have both elastic and ductile properties. When sheet metal is bent or formed below its elastic limit, it will spring back to its original shape. The elastic limit must be exceeded to effect permanent deformation, i.e. a bend. In bending sheet metal to a selected angle/radius, a certain amount of spring-back or return to the original shape will take place. Although a portion of the metal in a bend is permanently deformed, portions of any bend will remain below the elastic limit and cause spring-back. In order to achieve a finished bend angle/radius, the sheet metal must be over bent. A technique for overbending is disclosed in U.S. Pat. No. 5,551,272. This might include bending through a larger angle, bending with a smaller inside bend radius, or both.

As the inside bend radius becomes smaller, the amount of spring-back is reduced. In small radius bending situations, sheet metal may be bent to its finished angle/radius, and little spring-back will be experienced. This simplifies the roll forming process in that a profile may be bent to its finished form, with few provisions included for over bending. Small radius bends require little over bending. In addition, small radius bends tend to require fewer variations in over bending as sheet material physical properties vary.

As the inside bend radius becomes larger, the amount of spring-back increases dramatically. In large radius bends, sheet metal must be severely over bent to achieve a finished angle/radius. This complicates the roll forming process in that significant provisions must be made to contend with over bending, which can becomes somewhat unpredictable as inside bend radii become larger and sheet metal physical properties vary.

As defined herein a small radius bend is a bend whose inside bend radius measures between zero to five times the material thickness. A large radius bend is above five times the material thickness. For a typical sheet metal material having a 0.03 inch thickness then a large radius bend is 0.15 inch and above.

DISCLOSURE OF THE INVENTION

A method and apparatus is disclosed for forming curved shapes in a sheet material in such a way as to minimize the tendency of the material to return to an original shape. A sheet metal is passed between a series of spaced nodes on a node roller. The series may follow a flat or curved surface.

A backing roller with a smooth outer surface is opposite the node roller and has an outer surface complementary with the outer surface of the node roller with the sheet being passed therebetween. The node rollers form a plurality of small radius small angle bends between substantially flat segments to provide a curved shape resembling a true large radius curve. Curved shapes in gutter hoods and half round gutters are disclosed.

A second method discloses the forming of a curve in the bottom wall of a gutter using smooth roller surfaces before forming the series of bends and flat segments so as to reduce the tendency of the material to return to the original state.

BRIEF DESCRIPTION OF THE DRAWINGS

Details of this invention are described in connection with the accompanying drawings which like parts bear similar reference numerals in which.

DETAILED DESCRIPTION

Figure 1:
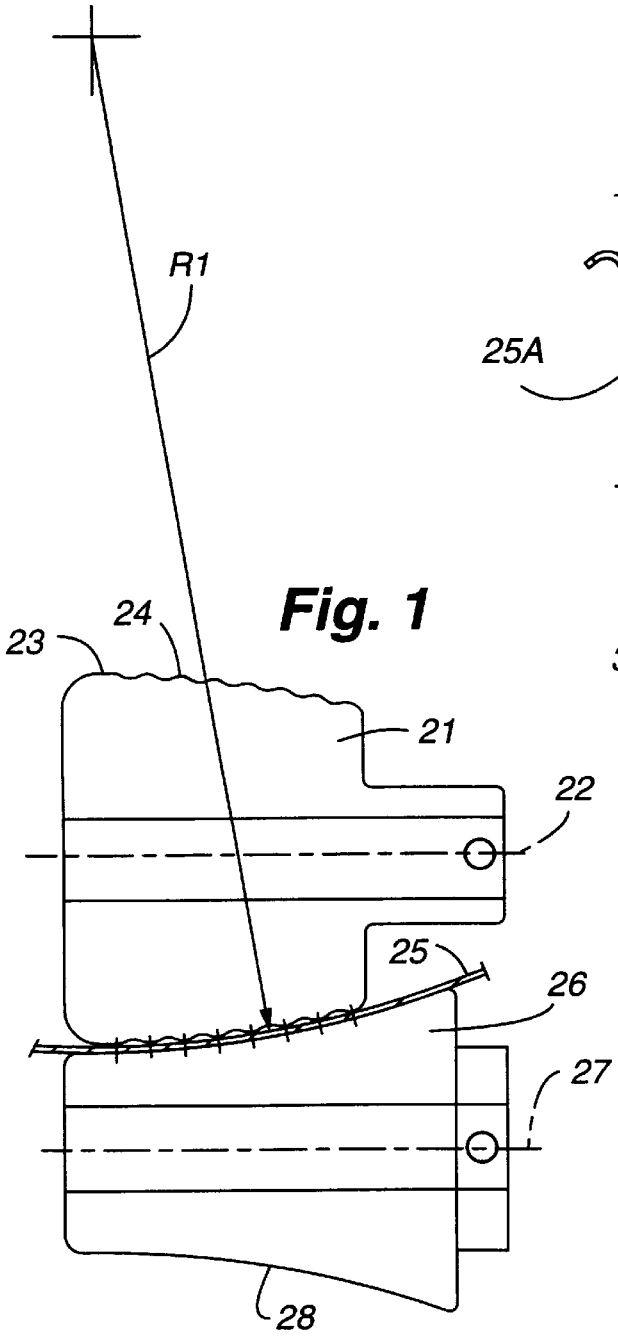
FIG. 1 is an end elevation view of the rollers of a first stage of roll forming apparatus embodying features of the present invention for making a curved gutter hood.
Figure 3:
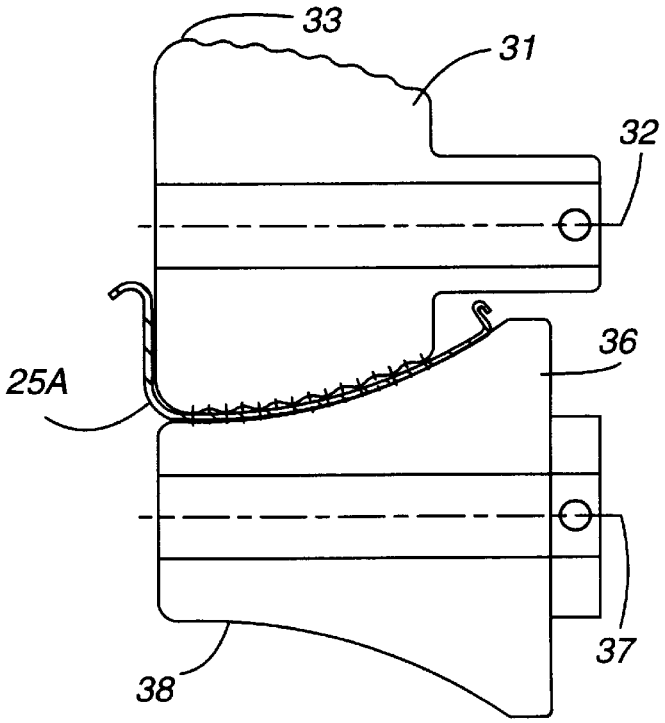
FIG. 3 is an end elevation view of the rollers of a second stage of roll forming apparatus for making a curved gutter hood.
Figure 2:
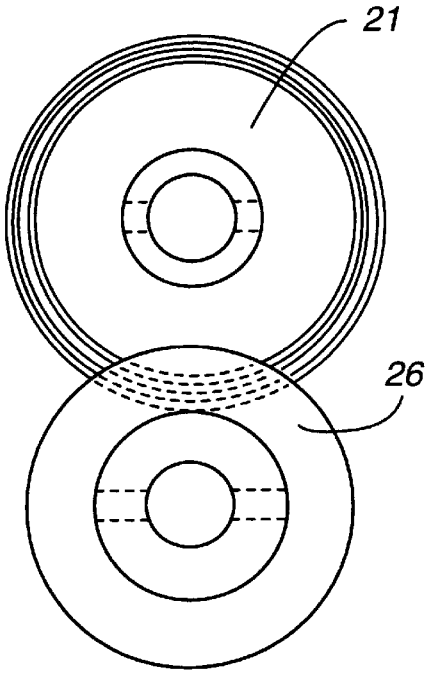
FIG. 2 is a side elevation view of FIG. 1.
Figure 1A:
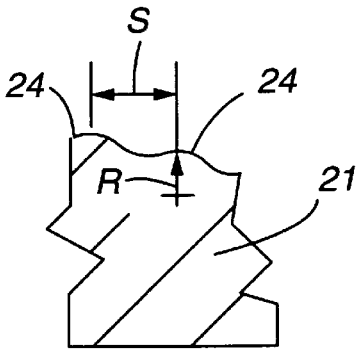
FIG. 1A is an enlarged view of a portion of FIG. 1.

Referring now to FIGS. 1–3 there is shown roll forming apparatus having two stations or stages for forming a curved shape resembling a radius curve in a sheet material. The element shown being formed is a hood for a gutter described in U.S. Pat. No. 5,845,435. In the first stage or station an upper node roller 21 is typically mounted on an upper shaft rotatable in suitable bearings in side supports for rotation about an axis of rotation 22. Roller 21 has an outer peripheral curved surface 23 extending generally along a convex curve of a selected radius designated R1 and is shown as formed with a series of eight laterally spaced ring-shaped, circumferential protuberances or nodes 24 having a selected radius designated R and a selected spacing designated S between nodes (FIG. 1A). The node roller 21 preferably is made of a material at least as hard as the sheet metal 25 being shaped.

A lower backing roller 26 is typically mounted on a lower shaft rotatable in suitable bearings in side supports for rotation about an axis of rotation 27. Backing roller 26 has a smooth outer concave surface 28 having a curvature that is complementary with or matches with the convex curve of surface 23 of roller 21. The backing roller 26 is made of a material substantially softer or weaker than the sheet material being formed. The clearance between the opposing rollers, preferably, is a distance that measures less than the thickness of the sheet material to be formed.

When the sheet material 25 is passed between the opposed node and backing rollers 21 and 26 the nodes 24 press portions of the sheet material 25 into the backing roller at the nodes. The softer material of the backing roller 26 allows the nodes to press point bends, point angles or point creases into and form small bends in the sheet material between substantially flat segments because the backing roller gives way at the node. The effect on the sheet metal is described in more detail hereafter. A typical material for the backing roller is acetyl plastic (Delrin). By way of example and not limitation a typical node radius R is 0.25 inches and node spacing S is 0.50 inches for the first stage for making a gutter hood. The outer curved surface R1 has a radius of 15 inches.

Referring now to FIG. 3 in the second stage there is shown an upper node roller 31 that rotates about an axis of rotation 32. The node roller 31 has an outer peripheral surface 33 arranged along a convex curve of a selected radius smaller than radius R1. This upper node roller 31 shown has a series of eight laterally spaced ring shaped circumferential nodes 34 formed in the outer surface 33. A lower backing roller 36 opposite node roller 31 rotates about an axis of rotation 37. Backing roller 36 has a smooth generally concave outer surface 38 that matches or is complementary with surface 33. The hood cover 25A with a curved wall is shown as formed between the rollers 31 and 36.

The nodes 34 on the second stage node roller 31 are located between the nodes 24 on the first stage node roller to form bends and angles in the material between the bends formed in the first stage to further increase the curvature in the material being shaped. In the second bend the angle between the flat faces decreases by one half and the width of the flat segments decreases by one half. For the second stage the node radius R is 0.25 inches, the spacing C is 0.25 inches and the radius of curves 33 and 38 is 8 inches. The roller stages achieve a 10 inch bend through an arc of about 25 degrees. There are 15 bends of approximately 1½ degrees each.

Figure 4:
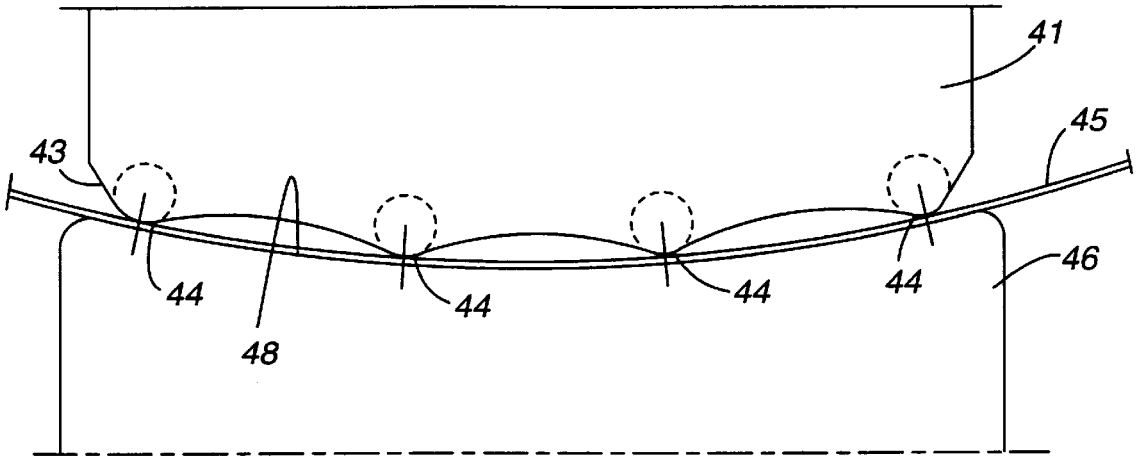
FIG. 4 is a schematic end elevation view of the rollers of a first stage of a roll forming apparatus for making a half round gutter.
Figure 5:
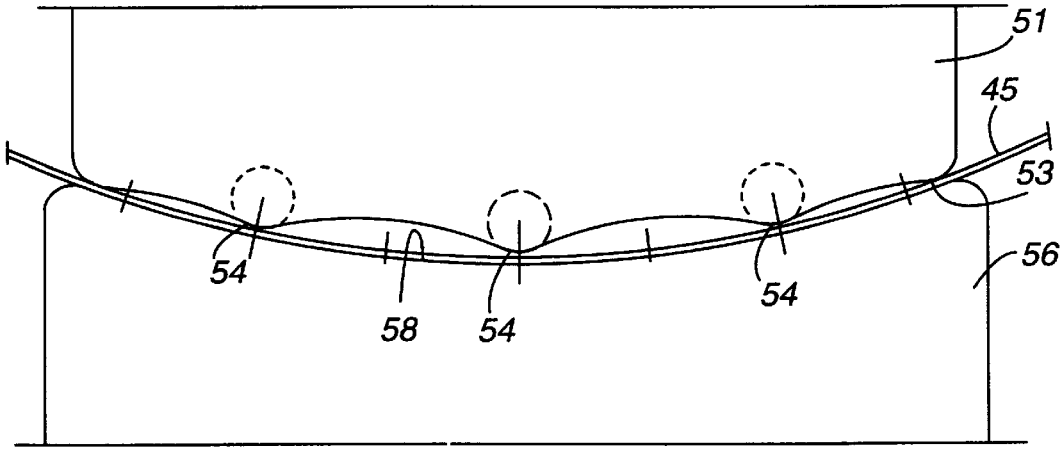
FIG. 5 is a schematic end elevation view of a second stage of the rollers of the apparatus of FIG. 4.
Figure 6:
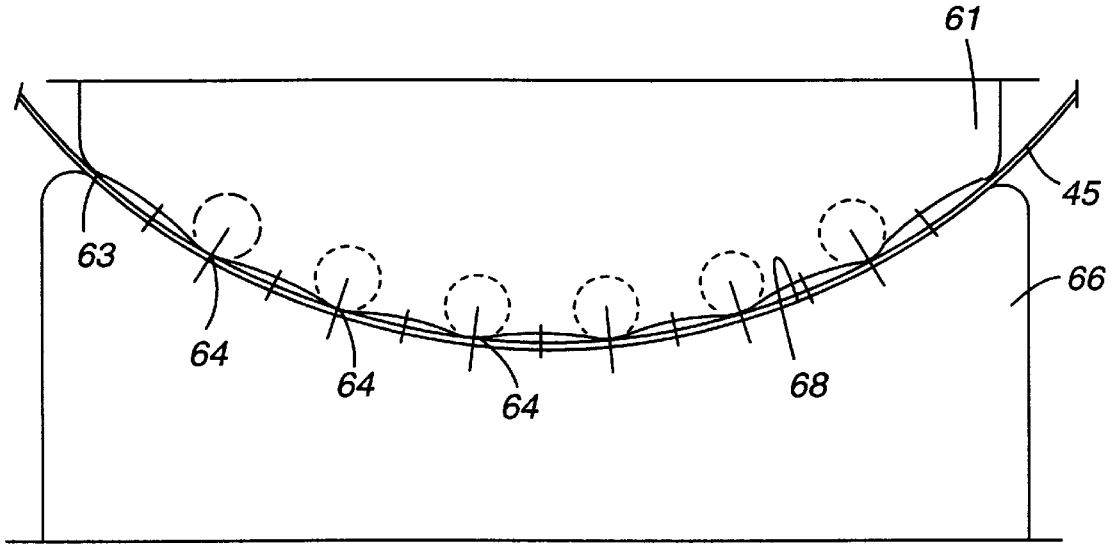
FIG. 6 is a schematic end elevation view of a third stage of the rollers of the apparatus of FIG. 5.

Referring now to FIGS. 4–6 there is shown schematically rollers in roll forming apparatus from three stages for forming a curved shape such as the bottom wall of a half round gutter. The first stage has an upper node roller 41 rotating about an axis. Node roller 41 has an outer peripheral surface 43 arranged along a concave curve of a selected radius. Node roller 41 has a series of four ring shaped circumferential spaced nodes 44 spaced across the surface of a sheet material 45. A backing roller 46 opposite node roller 41 rotates about an axis. Backing roller 46 has a concavely curved outer surface 48 that matches or is complementary with the convex curve 43 of the outer surface of node roller 41.

The second stage (FIG. 5) has an upper node roller 51 rotating about an axis. Roller 51 has an outer peripheral surface 53 arranged along a concave curve of a selected radius smaller than the nodes of the first stage. Node roller 51 has three laterally spaced ring shaped circumferential nodes 54. These nodes 54 are located between the nodes 44 of the first stage to further bend the sheet material 45. A backing roller 56 opposite node roller 51 rotates about an axis. Backing roller 56 has a concavely curved outer surface 58 that matches or is complementary to the curve 53 of the outer surface of node roller 51.

The third stage (FIG. 6) has an upper node roller 61 rotating about an axis. Roller 61 has an outer peripheral surface 63 arranged along a concave curve of a selected radius smaller than the radius of the previous stage. Roller 61 has six laterally spaced ring shaped circumferential nodes 64 located between the nodes 54 of the second stage to further bend the sheet metal 55. A backing roller 66 opposite roller 61 rotates about an axis. Roller 66 has a concavely curved surface 68 that matches the curve of surface 63.

The half round gutter will have approximately 60 bends of three degrees each to achieve a finished bend of 180 degrees. The term "small angle" as referred to herein is preferably below 25 degrees and typically 5 degrees or less.

Figure 7:
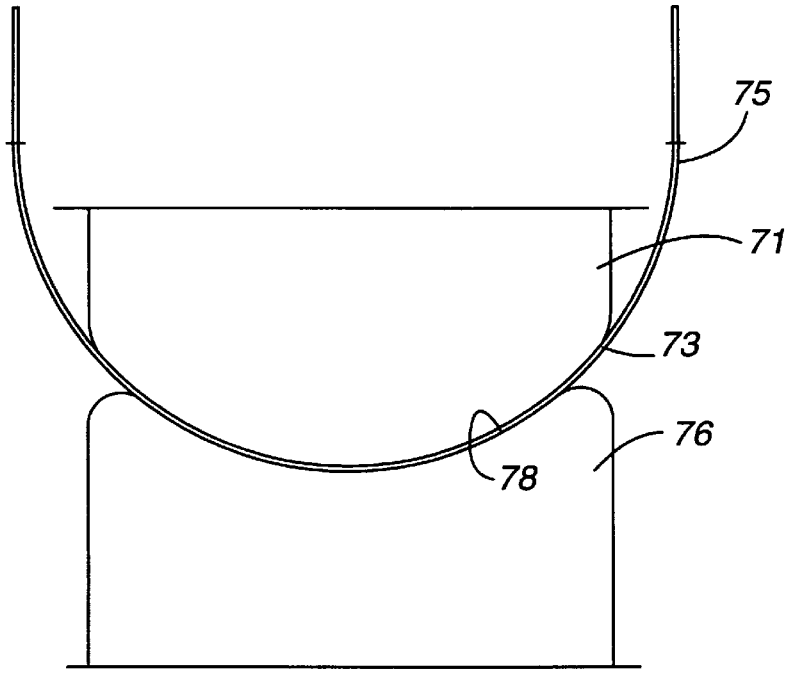
FIG. 7 is a schematic end elevation view of the rollers of a second embodiment of roll forming apparatus for making a half round gutter showing an alternative method
Figure 8:
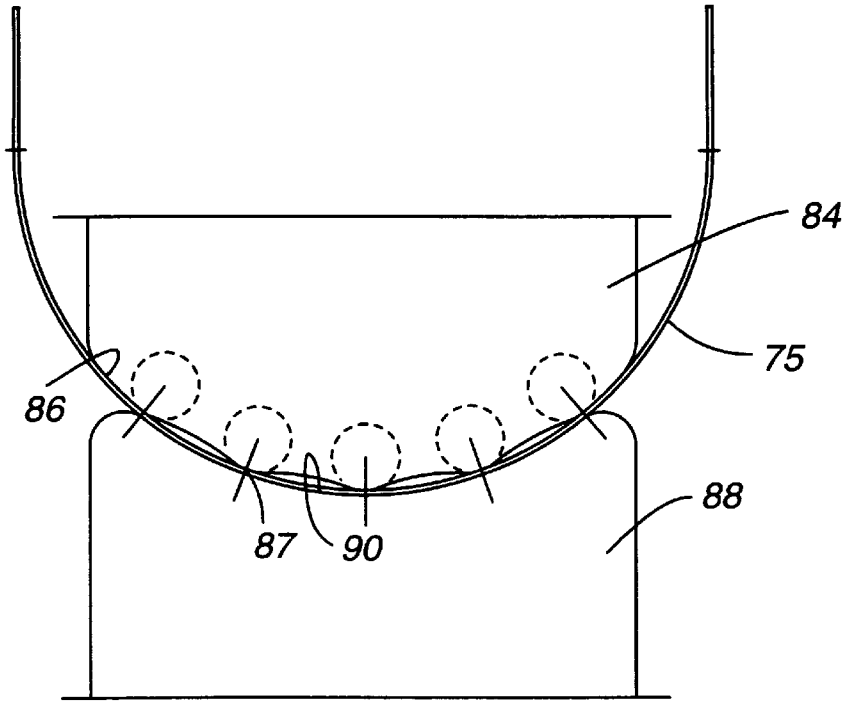
FIG. 8 is a schematic end elevation view of the rollers of a second stage of the apparatus of FIG. 7.
Figure 9:
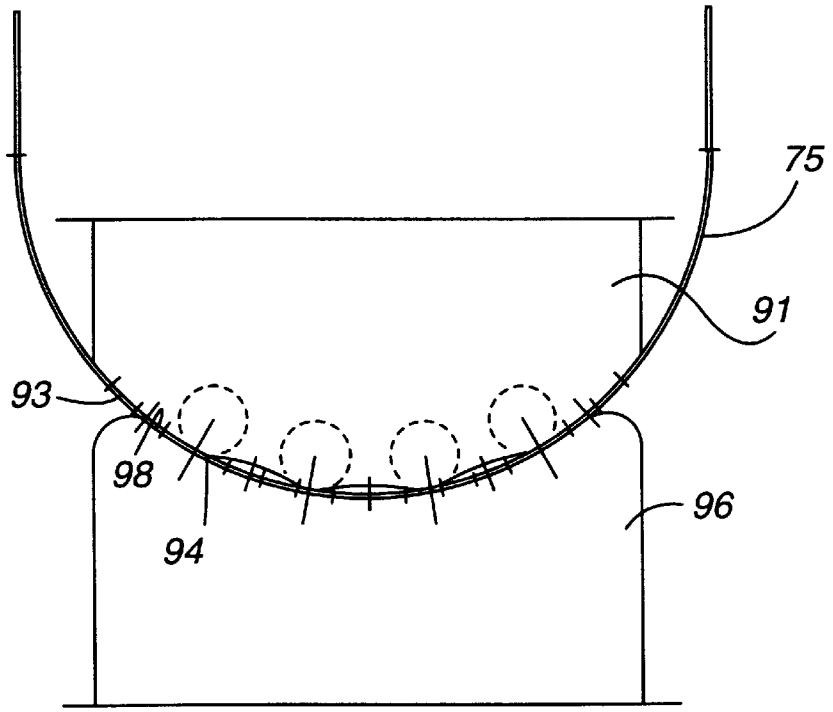
FIG. 9 is an end elevation view of the rollers of a third stage of the apparatus of FIG. 7.

Referring now to the embodiment shown in FIGS. 7–9 the roll forming apparatus has a smooth convex upper roller 71 with a smooth convexly curved surface 73 of a selected radius. As shown the radius is semi-circular to form a semi-circular shape in the bottom wall of a gutter. A lower roller 76 opposite roller 71 has a complementary smooth concave surface 78. A sheet material 75 is passed between the rollers. In this procedure a curve is formed prior to using the node and backing rollers.

The second stage (FIG. 8) has an upper node roller 84 rotating about an axis. The node roller 84 has an outer surface 86 arranged along a concave surface of a selected radius. The node roller has a series of five laterally spaced ring shaped circumferential nodes 87. Opposite the node roller 84 is a backing roller 88 that rotates about an axis. The material 73 passes between the node and backing rollers. The backing roller 88 has a concavely outer curved surface 90 that matches the curve of surface 86 of the node roller 84.

The third stage (FIG. 9) has an upper node roller 91 rotating about an axis. The upper node roller has an outer surface 93 arranged along a convex curve of a selected radius. Node roller 91 has a series of four spaced ring shaped circumferential nodes 94 located between the nodes of the second stage to further bend the sheet material 73. A backing roller 96 is opposite the node roller and rotates about an axis. The backing roller has a concavely curved outer surface 98 that matches the curve of the outer surface 93 of the node roller 91.

In accordance with the present invention, if enough small, closely spaced bends are applied to the sheet, the appearance of a curved shape resembles a radius bend.

Figure 10:
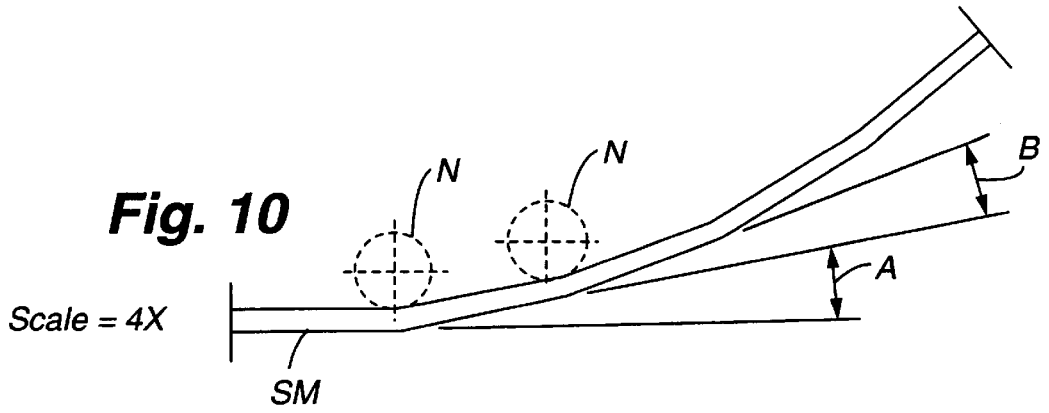
FIG. 10 is a schematic view showing the formation of a curve in sheet material.
Figure 11:
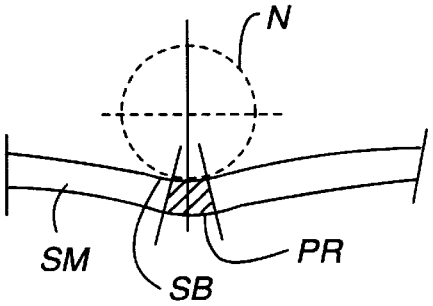
FIG. 11 is an enlarged view of the bend in the material at the node shown in FIG. 12A.

The above described apparatus and method will now be further explained with reference to FIG. 10 showing a sheet material SM on a scale of 4 times that has two spaced nodes N forming a series of two bends having angles designated A and B each of 10 degrees. At the full scale the bend resembles a true curve having a larger radius.

The present invention may be further explained with reference to a sequence illustrated in FIG. 11 and FIGS. 12A to 12D. The initial sheet material is a relaxed flat sheet not shown. The relaxed flat sheet material is engaged by a plurality or series of ring shaped circumferential nodes N (three shown) which are spaced across the top surface of the sheet material SM. This series may follow a flat or curved surface.

Elastic as used herein means the material returns to an original shape and plastic deformation means the material is permanently deformed.

Once the sheet is relaxed after being engaged by the nodes N, the cross section of the material becomes a series of small bends SB and small angles between flat segments with regions of plastic deformation PR at the bends.

Successfully creating regions of plastic deformation depends on the availability of elastic regions in the sheet between the nodes. If the nodes are too closely spaced, plastic deformation will be minimized at the nodes. Therefore, the more widely spaced the nodes, the more pronounced the localized regions of plastic deformation.

The nodes are organized in sequential passes to form bends in different parts of the sheet at different times. In this way, the nodes may remain appropriately spaced, while minimizing the overall separation between the small, closely spaced bends. It is important to note that previously deformed plastic regions will exhibit essentially elastic behavior when they pass through rollers in an elastic region. Just as in the case of the flat segment that flexes and springs back, a region that has experience plastic deformation will elastically deform, and then return to its previously bend state.

Figure 12A:
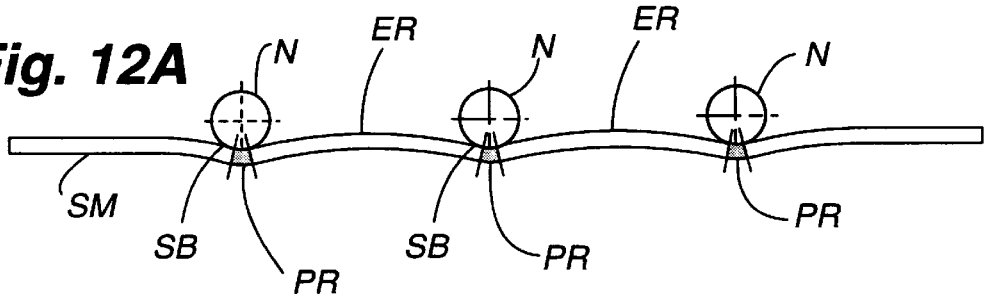
FIGS. 12A, 12B, 12C and 12D are a sequence of schematic views showing the forming of a curve in sheet material.
Figure 12B:
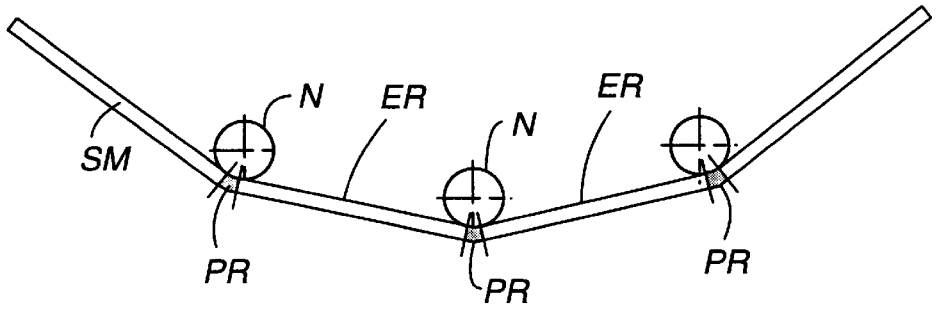
Figure 12C:
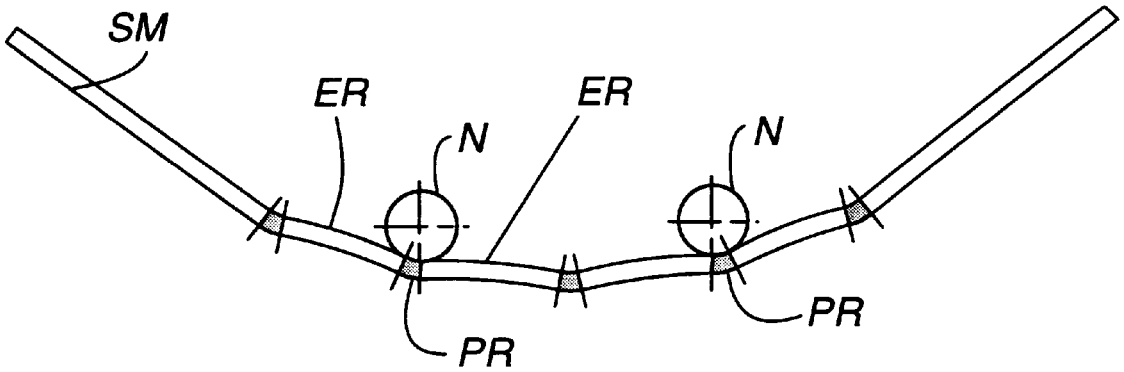
Figure 12D:
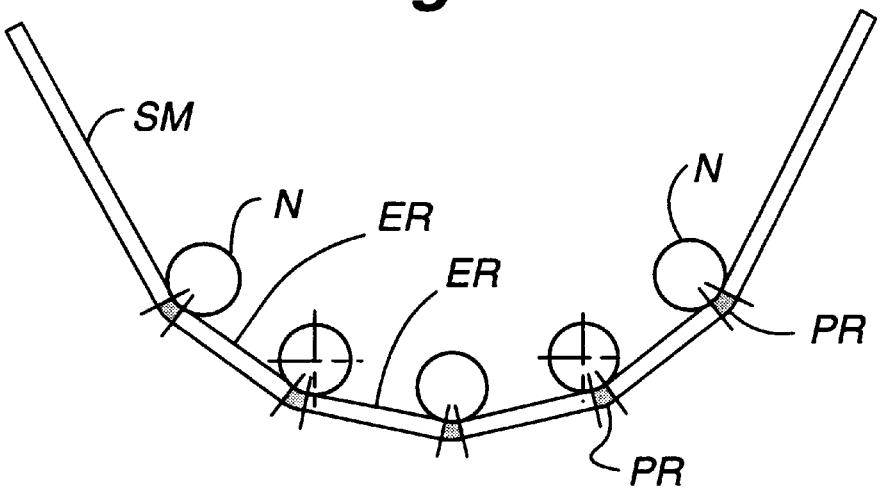

The first pass through the nodes N causes plastic regions PR at the node and elastic regions ER between regions PR that will return to a relaxed state when the sheet is relaxed. FIG. 12B shows a relaxed sheet after the pass through the nodes where the elastic regions return to a relaxed state and there is permanent deformation in the plastic regions PR. FIG. 12C shows a second pass through two spaced nodes N between or offset from the nodes of the preceding stage. The previously formed plastic regions PR become part of new elastic regions ER. FIG. 12D shows a relaxed sheet after passing through the nodes showing small closely spaced deformations (bends) that provide the appearance or resemblance of a true large radius bend.

An advantage of the above described method and apparatus is the ability to bend different thicknesses of material and different materials accurately. Further, curves can be made in any arc or segment of a circle as required.

Although the present invention has been described with a certain degree of particularity, it is understood that the present disclosure has been made by way of example and that changes in details of structure may be made without departing from the spirit thereof.

What is claimed is:

1. A method of forming a curved shape in a sheet material comprising the step of:

roll forming a plurality of laterally spaced, relatively small radius, small angle, longitudinally extending bends between substantially flat segments in said sheet material, thereby forming a lateral curve in said sheet material resembling a large radius curve.

2. The method as set forth in claim 1 wherein said sheet material is substantially flat before said step of roll forming.

3. The method as set forth in claim 1 further comprising the step of bending said sheet material into said curved shape before said step of roll forming.

4. The method as set forth in claim 1 wherein said step of roll forming includes the step of passing said sheet material between a first node roller and a first backing roller with said first node roller having a plurality of ring shaped first nodes, each said first node extending around the circumference of said first node roller, said first nodes and said first backing roller forming a first series of said bends in said sheet material.

5. The method as set forth in claim 4 wherein said first nodes are arranged along a convex curve having a selected radius with said first backing roller having a backing surface arranged along a corresponding complementary concave curve.

6. The method as set forth in claim 4 wherein said first node roller is made of a material at least as hard as the sheet material being shaped, said first backing roller is made of a material substantially softer than the sheet material being shaped, the clearance between said first node and backing rollers being less than the thickness of the material being shaped whereby said first backing roller yields at the node during the forming of said bends.

7. The method as set forth in claim 4 wherein said step of roll forming includes the step of passing said sheet material between a second node roller and a second backing roller with said second node roller having a plurality of ring shaped second nodes, each said second node extending around the circumference of said second node roller, said second nodes and said second backing roller forming a second series of said bends in said sheet material between said first series of bends.

8. The method as set forth in claim 1 wherein said step of roll forming includes passing said sheet material through at least four successive stages of opposed pairs of node rollers and backing rollers with each node roller having a plurality of ring shaped nodes extending around the circumference of said node roller, said nodes on each succeeding node roller arranged to form a series of small radius, small angle bends between the preceding series of small radius, small angle bends.

9. The method as set forth in claim 1 wherein said sheet material is sheet metal between about 0.01 inch and 0.10 inch thick.

10. A method of forming a curved shape in a sheet metal material comprising the step of:

passing said sheet material between a node roller and a backing roller, said node roller having a plurality of ring shaped circumferential nodes arranged along a convex curve having a selected radius and said node roller being made of a material at least as hard as the sheet metal material being shaped, said backing roller having a backing surface arranged along a corresponding complementary concave curve to said convex curve and being made of a material substantially softer than the sheet material being shaped, and a clearance between said nodes and said backing surface being less than the thickness of the material being shaped whereby said backing surface yields at said nodes during the passing of the material between said node roller and said backing roller to form a plurality of spaced relatively small radius, small angle bends between substantially flat segments in said sheet material.

11. A roll forming station for roll forming a curved shape in a sheet material comprising:

opposed node and backing rollers through which said sheet material is passed during rotation of said rollers, said node roller having a series of laterally spaced ring shaped nodes each extending around the circumference of said node roller, said nodes having a selected shape and selected spacing, said backing roller having a smooth surface opposite said nodes, whereby said nodes form a series of spaced relatively small radius, small angle bends in said sheet material when passed between said pair of rollers to form a radius curve in said sheet material so as to reduce the tendency of said material to return to an original shape.

12. The station as set forth in claim 11 wherein said node roller is made of a material at least as hard as the material being shaped, said backing roller is made of a material softer than the sheet material being shaped, and the clearance between said nodes and said backing roller is less than the thickness of said material, said backing roller allowing said nodes to press bends into the sheet material because the backing roller yields at each said node.

13. A roll forming apparatus for forming a curved shape in a sheet material comprising:

opposed first node and backing rollers through which said sheet material is passed during rotation of said rollers, said first node roller having a series of laterally spaced ring shaped first nodes each extending around the circumference of said first node roller, said first nodes having a selected shape and selected spacing, said first backing roller having a smooth surface opposite said first nodes, whereby said first nodes form a first series of spaced relatively small radius, small angle bends in said sheet material when said sheet material is passed between said first rollers to form a curve in said sheet material so as to reduce the tendency of said material to return to an original shape.

14. Apparatus as set forth in claim 13 further including opposed second node and backing rollers, said second node roller having a series of laterally spaced ring shaped second nodes each extending around the circumference of said second node roller, said second backing roller having a smooth surface opposite said second nodes, and said second nodes being aligned with said first nodes such that said second nodes form a second series of relatively small radius, small angle bends between said first series of bends.

15. Apparatus as set forth in claim 13 wherein said first node roller is made of a material at least as hard as the sheet material being shaped, said first backing roller is made of a material substantially softer than the sheet material being shaped, the clearance between said first node and backing rollers being less than the thickness of the material being shaped whereby each backing roller yields at the first nodes during the forming of said first series of bends.

16. Apparatus as set forth in claim 13 wherein the radius of each first node is about 0.25 inches and the spacing between each first node is about 0.5 inches.

17. Apparatus as set forth in claim 13 wherein said first nodes are arranged along a convex curve having a selected radius with said first backing roller having a backing surface arranged along a corresponding complementary concave curve.

18. Apparatus as set forth in claim 13 each first node has a cross section with a circular arc and is ring shaped to extend around the circumference of said first node roller.

19. Apparatus as set forth in claim 18 including grooves in the shape of a circular arc between each of said first nodes that extend around the full circumference of said first node roller.

20. Apparatus as set forth in claim 13 wherein said sheet material is formed into a curved hooked cover for a hooded gutter.

21. Apparatus as set forth in claim 13 wherein said sheet material is formed into a half round gutter.

22. A roll forming apparatus for forming a curved shape in a sheet metal material comprising:

opposed first node and backing rollers through which said sheet metal material is passed during rotation of said first rollers, said first node roller having a series of laterally spaced ring shaped, circumferential first nodes arranged along a convex curve having a selected radius, said first nodes having a selected shape and selected spacing, said first node roller being made of a material at least as hard as the sheet material being shaped, said first backing roller having a smooth backing surface arranged along a corresponding complementary concave curve opposite said first nodes, said first backing roller being made of a material substantially softer than the sheet material being shaped, the clearance between said first node and backing rollers being less than the thickness of the material being shaped, whereby said backing surface yields at said first nodes and said first nodes form a first series of spaced relatively small radius, small angle bends in said sheet metal material, and opposed second node and backing rollers through which said sheet metal material is passed after passing through said first rollers, said second node roller having a series of laterally spaced ring shaped, circumferential second nodes arranged along a convex curve having a selected radius, said second nodes having a selected shape and selected spacing, said second node roller being made of a material at least as hard as the sheet material being shaped, said second backing roller having a smooth backing surface arranged along a corresponding complementary concave curve opposite said second nodes, said second backing roller being made of a material substantially softer than the sheet material being shaped, the clearance between said second node and backing rollers being less than the thickness of the material being shaped whereby said backing surface yields at said second nodes, said second nodes being aligned with said first nodes such that said second nodes form a second series of relatively small radius, small angle bends between said first series of bends.

* * * * *